United States Patent [19]

Roccaforte

[11] 3,938,703

[45] Feb. 17, 1976

[54] DISPENSING CARTON FOR NESTABLE CUPS

[75] Inventor: Harry I. Roccaforte, Western Springs, Ill.

[73] Assignee: Hoerner Waldorf Corporation, St. Paul, Minn.

[22] Filed: Feb. 19, 1975

[21] Appl. No.: 550,947

[52] U.S. Cl. ..... 221/305
[51] Int. Cl.² ..... A47F 1/08
[58] Field of Search ..... 221/307, 309, 310, 305, 221/131; 229/17 B, 51 TS

[56] References Cited

UNITED STATES PATENTS

| | | | |
|---|---|---|---|
| 1,565,306 | 12/1925 | Bergman et al. | 221/310 |
| 2,360,765 | 10/1944 | Davidson | 221/307 X |
| 2,861,717 | 11/1958 | Vines | 221/307 |
| 3,820,686 | 6/1974 | Tyrseck | 229/17 B X |

*Primary Examiner*—Stanley H. Tollberg
*Attorney, Agent, or Firm*—Jerry F. Best

[57] ABSTRACT

Paperboard dispensing carton adapted for use with a stacked or nested array of paper cups or the like which includes a rectangular tube with closures at both ends surrounding the cups and a removable tear strip opener at the bottom of the carton removable to expose the bottom of the stack of cups, and means on the inside of the carton near the bottom to frictionally engage the lip of the cups so that they will remain in the carton and be removable singly by hand.

4 Claims, 14 Drawing Figures

DISPENSING CARTON FOR NESTABLE CUPS

BACKGROUND OF THE INVENTION

1. Field of the Invention

This invention relates generally to dispensing cartons and more particularly to cartons and packages which are particularly adapted to contain and dispense articles arranged in a nested array or stack where the articles are paper cups or the like.

2. Description of the Prior Art

The distribution of paper cups for home or commercial use is presently done by shipping the cups in paperboard containers or cartons and then removing them from the container and placing them in special dispenser devices which may be permanently fixed to a wall or counter and made of plastic, metal, or some other material. The present invention is designed to eliminate the need for a separate dispensing device and eliminate the requirement of removing the cups from the carton and placing them in the dispenser. The present invention may be adhesively attached to the surface or may be left on the counter top, apertured wall bracket or other surface so that when a cup is to be removed the carton is simply picked up and the cup removed from the bottom. In this manner the carton need not be kept in the open unless so desired and may be kept in the cabinet or otherwise hidden from view.

SUMMARY OF THE INVENTION

A carton and blank for making same designed to be part of a package containing a stack of paper cups which is a rectangular cross section tube of paperboard or similar material containing the stack of cups and having a removable lower end closure adapted to be removed to expose the cups on the bottom end, and also means located on the inside surface at the lower end of the carton for frictionally engaging the outer edges of the cups to retain them in position so that they may be withdrawn singly by hand.

DETAILED DESCRIPTION OF THE PREFERRED EMBODIMENT

Figure 1:
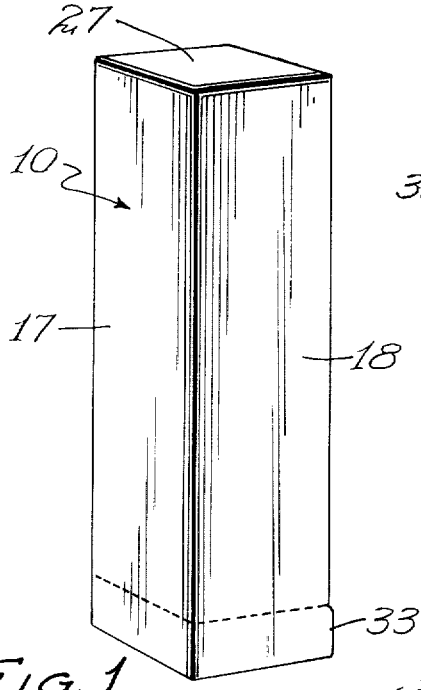
FIG. 1 is a perspective view of a package embodying the present invention prior to opening.
Figure 2:
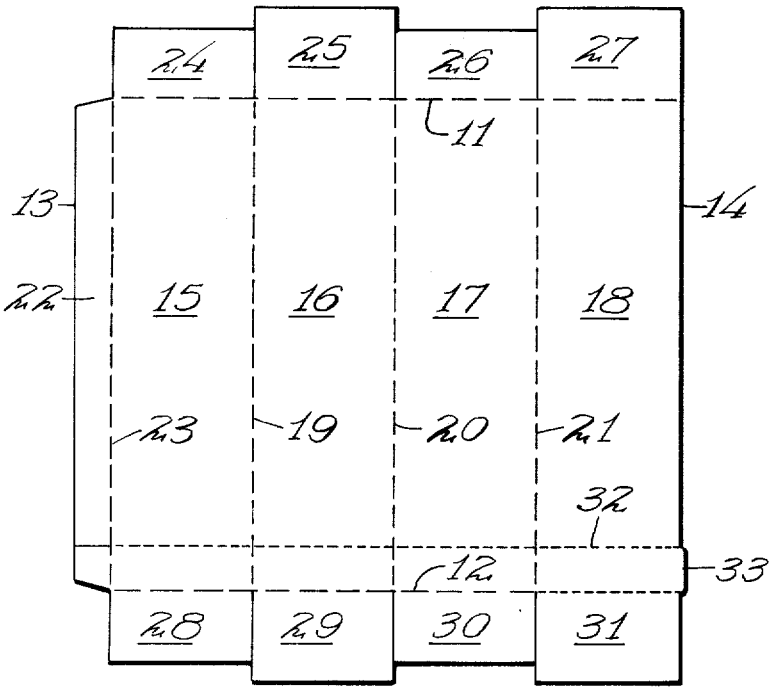
FIG. 2 is a plan view of a blank embodying the present invention and adapted to be folded into a carton package similar to that shown in FIG. 1.

The package in FIG. 1 which is illustrated in perspective view is one embodying the present invention and labeled generally as 10. It is in this form that the package, containing the nested array of cups or the like, is stored and shipped and sold to the ultimate consumer. This package 10 is made up of a carton formed from a blank such as that shown in FIG. 2 which is made from foldable paperboard or similar sheet-like material and is substantially rectangular in shape having a pair of parallel top and bottom edges defined by the fold lines 11 and 12 as well as parallel lateral edges 13 and 14 which are arranged perpendicular to the top and bottom edges 11 and 12. Since the cups which are to be stored in the carton are circular in cross section, it is most expedient to make the carton rectangular in cross section to save space. Therefore the blank as shown in FIG. 2 includes four side wall panels 15, 16, 17 and 18 of equal width which are arranged in side-by-side relationship and are defined by three fold lines spaced intermediate the two lateral edges 13 and 14 numbered 19, 20 and 21 which are parallel to one another and define the four side wall panels 15 through 18. In the particular embodiment shown, a manufacturer's glue flap 22 is connected along one lateral edge of the blank to the side wall 15 by the fold line 23.

Along the top edge 11 of the blank are connected four top closure flaps 24, 25, 26 and 27 which are illustrated as a conventional top closure and serve to retain the cups in the carton and to keep them clean. Along the bottom edge 12 of the blank are hingedly connected bottom closure flaps 28, 29, 30 and 31 which form a similar closure to that on the top of the carton.

Figure 4:
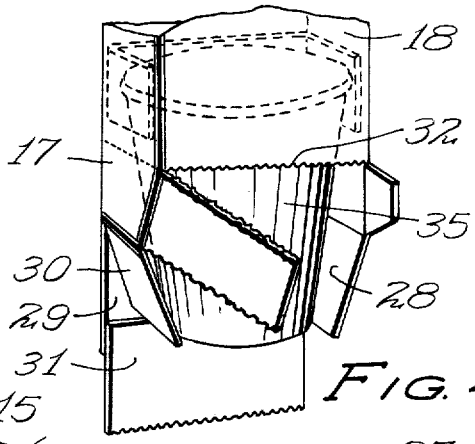
FIG. 4 is a perspective view of the lower portion of the package shown in FIG. 1 illustrating the removal of the bottom closure assembly.

Along the bottom edge 12 of the blank is formed integrally therewith a tear strip opener which in the present embodiment is shown as an interrupted line cut 32 which extends across the bottom of the blank parallel to the bottom edge 12 and defines a portion of each of the side wall panels 15 through 18 which lies between the interrupted line cut 32 and the bottom edge 12 which is removed by pulling the tear strip. For convenience a small extension 33 may be formed at the end of the tear strip opener in order to assist in grasping the opener, and in order to facilitate removal of the bottom of the carton that portion of the bottom edge 12 which extends across the side wall panel 18 which is adapted to become the front of the carton is also formed as an interrupted line cut so that, as can be seen in FIG. 4, the tearing of the strip easily initiates the removal of the entire bottom end of the carton. The exact type or configuration of tear type opener across the bottom of the carton may be varied and it is important for purposes of this invention only that the bottom of the carton be removable.

Figure 6:
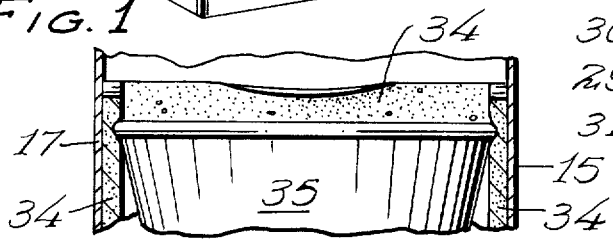
FIG. 6 is an enlarged view of a portion of the sectional view shown in FIG. 5 illustrating the frictional engagement of the cups by the expanded foam plastic on the inside surface of the carton.
Figure 5:
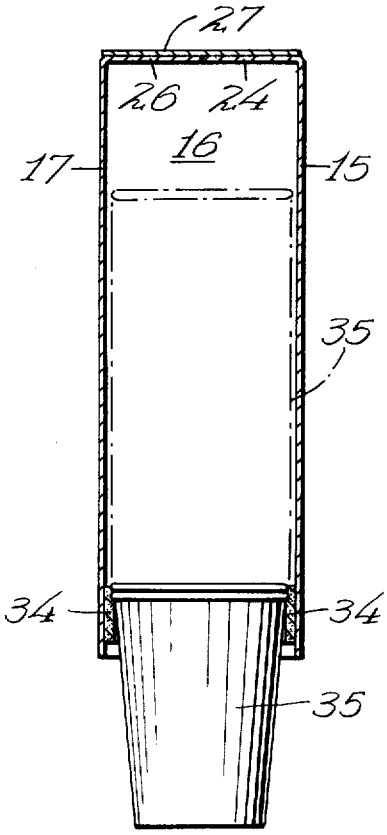
FIG. 5 is an elevational section view of a package similar to that shown in FIG. 1, but with the bottom closure removed and the nested array of cups in position for removal from the carton.

The blank as shown in FIG. 2 is illustrated with the outside surface up. The same blank is shown with the inside surface up in FIG. 3, and only the bottom portion of the blank is illustrated, showing a means for frictionally engaging the lip or edge of the cups which are in the stacked array within the package 10. It has been found that a thin strip of expanded foam plastic or other material which has a relatively high friction coefficient against the edges of paper cups may be placed on one or more of the interior surfaces of the side walls 15 through 18 of the blank which is to be erected into the package 10 and that, as seen in FIG. 6, the lip of the cup will be frictionally engaged by this material, which is shown as 34 and is adhesively attached or attached by some other means to the surface of the paperboard. With the package 10 in the open configuration shown in FIG. 5, the cups are simply withdrawn one at a time from engagement with the friction means 34 and the balance of the stack of cups remain inside the package 10 for further use.

The exact dimensions of the side walls 15 through 18 of the package 10 will determine in part whether it is necessary to place expanded foam plastic or other friction material 34 on one or more of the sides of the package. The tolerance between the inside dimensions of the package 10 and the diameter of the cups, which are shown generally as 35, as well as the thickness and resiliency of the friction means 34 and the weight of the stack of cups 35 must be considered. In the particular embodiment shown, the friction means 34 is positioned on three of the four sides of the package 10 and adhesively attached near the ends of the piece of friction material 34 as well as where the ends of the material 34 occur along the hinge lines 19 and 20 joining the adjacent side wallpanels. This allows the thin strip of friction material 34 to move away from the side wall panels 15, 16 and 17 and more fully engage the edges of the cup while they are in position.

Figure 7:
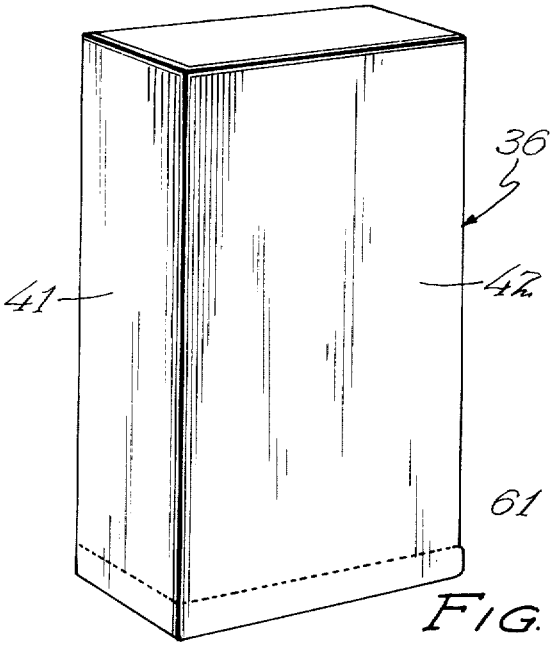
FIG. 7 is a perspective view of a package embodying the present invention which is designed to contain two stacked arrays of cups in side-by-side relationship.

The basic principle of this invention may easily be incorporated into a modification of the blank and package 10 utilizing two stacks of cups 35 in side-by-side relation which results in a package which prior to opening is like that shown in FIG. 7 and designated generally as 36. The blank which is utilized to make this package 36 can be seen in FIG. 8 and is similar to the blank of FIG. 2 in many respects in that it has a top edge 37 and a bottom edge 38 defined by two horizontal and parallel fold lines, and four outside wall panels 39, 40, 41 and 42 which are arranged in side-by-side relationship and are defined laterally by an outside edge 43 and four parallel fold lines arranged perpendicular to the top and bottom edges 37 and 38 and designated 44, 45, 46 and 47. It will be noted that the two outside wall panels 40 and 42 are approximately twice as great in width as the side wall panels 39 and 41. This is necessary because of the fact that two stacks of cups will be contained in the package in side-by-side relationship. In addition to the four outside wall panels 39 through 42, there are adjacent to the panel 39 and connected by fold line 47 a center reinforcing panel 48 and connected thereto along a fold line 49 is a center spacer panel 50 which has attached thereto a manufacturer's glue flap 51 along a vertical hinge line 52.

Figure 14:
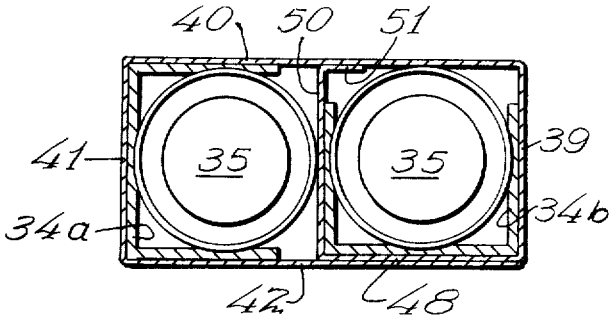
FIG. 14 is a view from the bottom of the package as shown in FIG. 13.

Along the top edge 37 of the four outside wall panels 39 through 42 are hingedly connected top closure flaps 53, 54, 55 and 56 which fold together to form a conventional closure similar to that of the single package 10, and hingedly attached along the bottom edge 38 to the same respective outside wall panels are bottom closure flaps 57, 58, 59 and 60 which form the bottom closure for the carton. The center partition wall panel 50 and the reinforcing panel 48 as well as the manufacturer's glue flap 51 are all foldable on the inside of the carton, and for that reason they extend in length vertically slightly less than the outside wall panesl 39 through 42, and in addition they do not extend at the bottom completely down to the fold line 38 since there is an interrupted line cut 61 formed across the bottom of the blank parallel to the fold line 38 and spaced from that bottom fold line 38 an amount which brings it up to the bottom edge of the two panels 48 and 50. Also the fold line 38 is formed as an interrupted line cut across the panel 42. In this manner the tear strip and bottom closure are removable to leave the bottom of the package open with the edge remaining, that edge being 61, substantially uniform with the bottom of the two panels 48 and 50 which form and support the divider separating the two stacks of cups 35. The relationship between all of these panels is best seen in FIG. 14 which is a view from the bottom of an opened carton such as that shown in FIG. 13, which shows how the center wall partition 50 is held in place by the manufacturer's glue flap 51 and the reinforcing panel 48.

Figure 3:
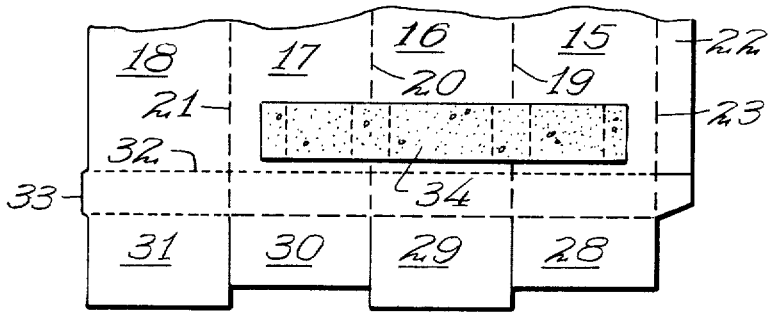
FIG. 3 is an enlarged plan view of a portion of the blank shown in FIG. 2 showing the inside surface and a strip of expanded foam plastic adhered thereto.
Figure 8:
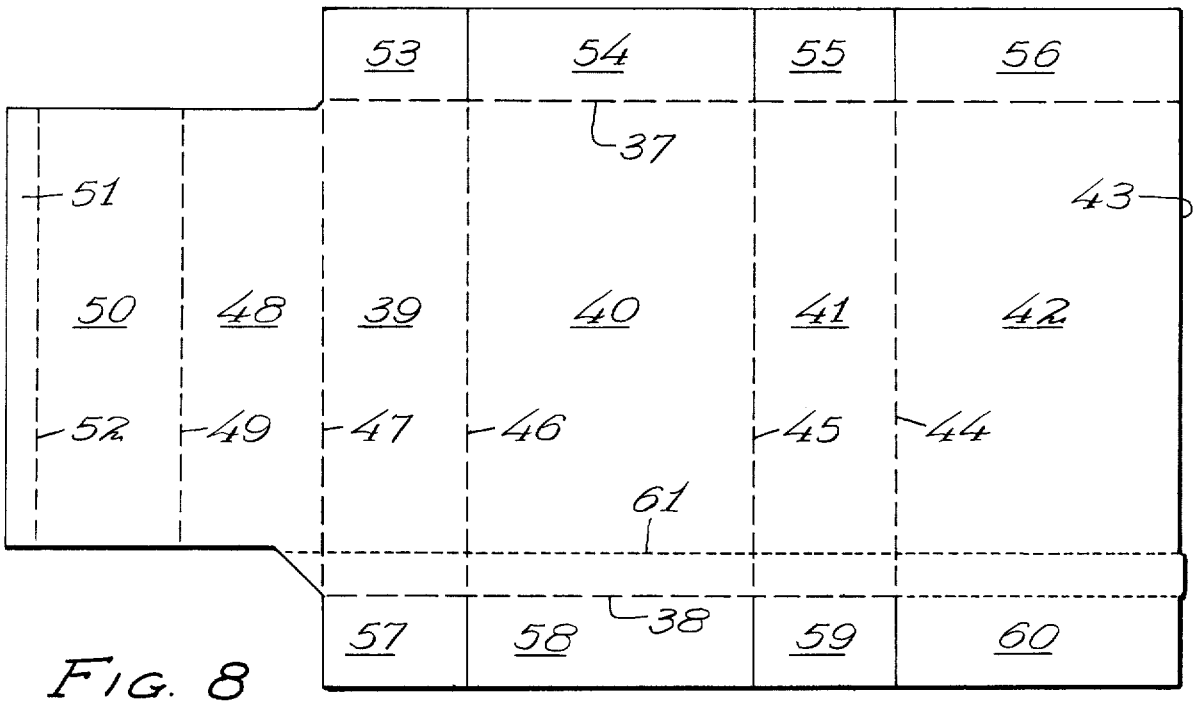
FIG. 8 is a plan view of a blank adapted to be folded into a carton embodying the present invention and similar to that shown in FIG. 7.
Figure 9:
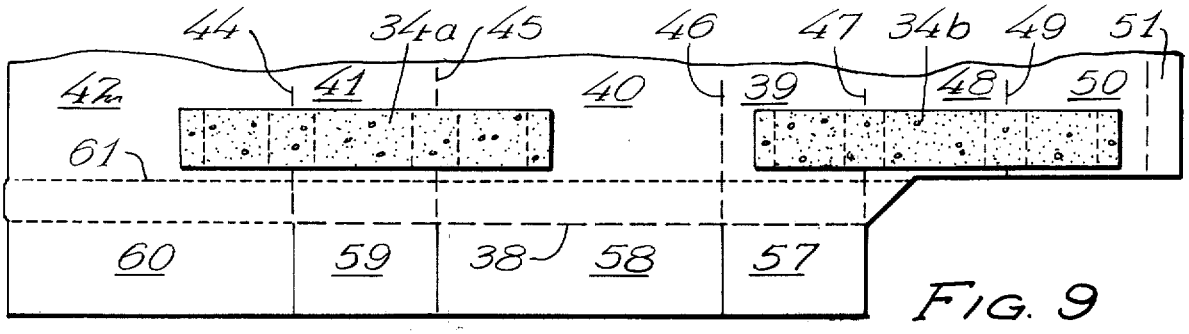
FIG. 9 is a plan view in expanded proportions of the lower portion of the blank shown in FIG. 8 illustrating the application of the strips of expanded foam plastic thereto.
Figure 10:
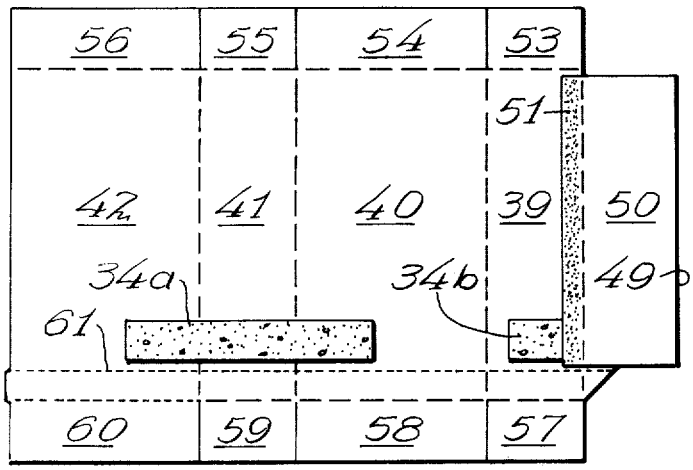
FIG. 10 is a plan view of the blank shown in FIG. 8 with expanded foam attached illustrating the method of folding same during assembly.
Figure 11:
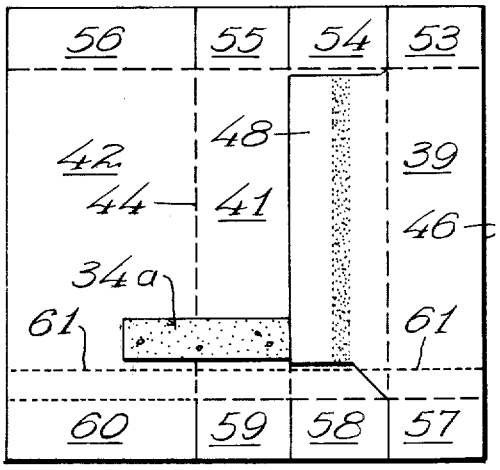
FIG. 11 is a plan view of the blank shown in FIG. 10 further illustrating the assembly technique which may be employed to fabricate the package.

As in FIGS. 2 and 3, the blank of FIG. 8 is shown with its outside surface up, and FIGS. 9 through 11 are shown with the inside surface up, at least to start with. Since there are two compartments for cups 35, it is necessary in this two cell embodiment to place means for frictionally engaging the cups, which will again be referred to as 34, in each of the two cells. Therefore, as shown in FIG. 9 a strip of expanded foam plastic is adhered at its ends and along the hinge lines 44 and 45 as well as on the outer panel 39 as well as the reinforcing or brace panel 48 and the center partition panel 50 by adhesively attaching at its ends and along hinge lines 47 and 49. For clarity the two respective pieces of friction inducing material are labeled **34*a* and 34*b*** respectively, and again it should be mentioned that the extent and size of these pieces of material is dictated by the tolerence of the interior surface dimensions as compared to the diameter of the cups to be stacked therein.

Figure 13:
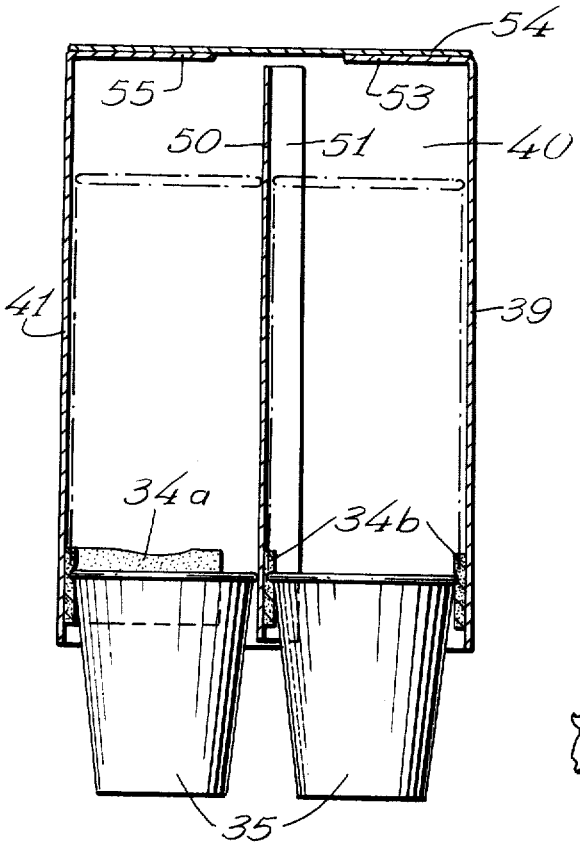
FIG. 13 is a front elevational section view of the package shown in FIG. 7 with the bottom removed illustrating the relationship of the two stacks of cups in the package in position prior to removal therefrom.
Figure 12:
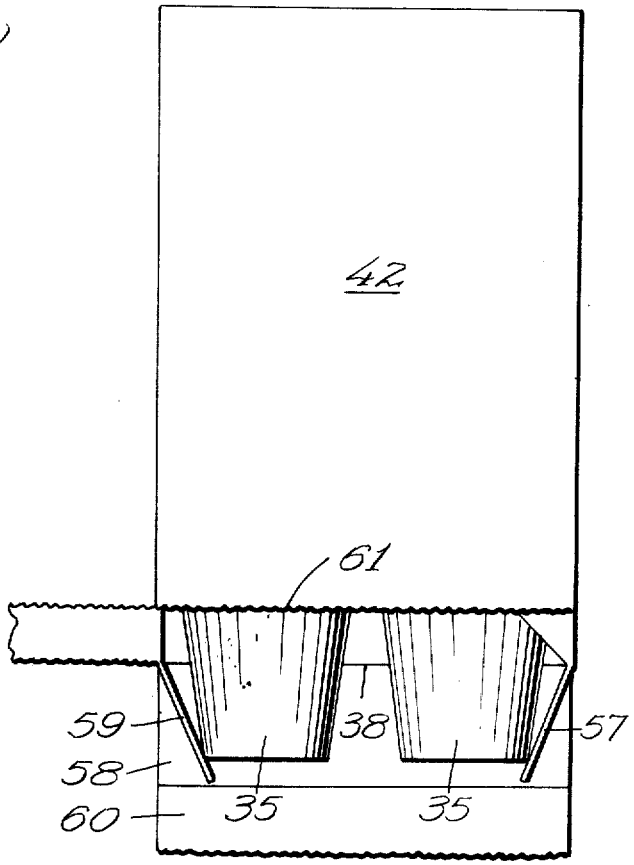
FIG. 12 is a front elevational view of the package shown in FIG. 7 with the bottom closure partially removed and cups exposed.

The folding of the blank shown in FIGS. 8 and 9 should be noted and as seen in FIG. 10, the first step is to fold the center partition wall panel 50 and manufacturer's glue flap 51 into face-to-face relationship with the reinforcing panel 48 by folding along the hinge line 49 as shown in FIG. 10. Adhesive is then applied to the exterior surface of the manufacturer's glue flap 51 and the face-to-face panels 50 and 48 along with the adjacent outer wall panel 39 are folded along the hinge line 46 into face-to-face relationship with the large exterior panel 40 as seen in FIG. 11 thereby providing the contact and adhesion between the manufacturer's glue flap 51 and its appropriate position on the interior surface of the outside panel 40. The large outside panel 42 is then folded along hinge line 44 to overlie the reinforcing or brace panel 48 and is adhesively attached thereto, completing the carton in its collapsed form. The package 36 is then erected by properly unfolding the collapsed carton blank, inserting the stacks of cups 35, and closing the top and bottom ends by conventional means. As can be seen in FIG. 12, the tear strip opener operates to remove the entire bottom of the package 36 and exposes the two stacks of cups 35 and allows them to drop down as can be seen in FIG. 13 and frictionally engage the members 34*a* and 34*b* to prevent them from falling out.

In accordance with the Patent Statutes, I have described the principles of construction and operation of my improvement in DISPENSING CARTON FOR NESTABLE CUPS; and while I have endeavored to set forth the best embodiment thereof, I desire to have it understood that obvious changes may be made within the scope of the following claims without departing from the spirit of my invention.

I claim:

1. A blank made from foldable paperboard or similar sheet-like material adapted to be folded into a tubular carton suitable for containing and dispensing a stacked array of nestable cups or the like, said blank comprising:

a substantially rectangular sheet of said paperboard, said sheet having parallel top and bottom edges and parallel lateral edges arranged at right angles to said top and bottom edges;

four side wall panels defined by three vertically oriented fold lines spaced intermediate said lateral edges and arranged parallel thereto, said side panels having substantially equal width;

closure flaps hingedly connected along said top edge of said blank to said wall panels and adapted to be folded to form a top closure for said carton in the finally erected configuration;

bottom closure flaps hingedly connected along said bottom edge to said side panels and adapted to be folded into a bottom closure for said carton in its finally erected configuration;

means formed integral with said blank and extending across the lower end of said blank for effecting removal of the lower portion of said blank including said bottom closure to provide access to said cups in the final erected configuration of the carton; and a layer of expanded foam plastic on at least one of said side walls positioned near the lower end thereof, said layer attached near the adjacent vertically oriented fold lines leaving a section of said plastic unattached near the center of said side walls.

2. The blank of claim 1 wherein said means for removing the bottom of said carton blank comprises a tear strip type opener formed in said blank parallel to the bottom edge of said blank and extending across said bottom end of said blank.

3. A storage and dispensing carton for a nested array of stackable cups or the like, comprising:

a rectangular tube of rigid paperboard or similar sheet-like material surrounding said nested array of cups;

means at the top of said tubular carton for closing the end of said carton and retaining said cups in said carton;

means located at the bottom end of said carton for effecting a closure to retain said cups in said carton during shipment and storage;

means located adjacent to said bottom closure means for effecting removal of said bottom closure means; and a layer of expanded foam plastic on at least one of said side walls positioned near the lower end thereof, said layer attached near the lateral edges of said side walls leaving a section of said plastic unattached near the center of said side walls.

4. The carton of claim 3, including a partition bisecting said carton along the vertical length thereof to permit two nested arrays of cups in side-by-side relationship.

* * * * *